US010584493B2

(12) United States Patent
Jenkins et al.

(10) Patent No.: US 10,584,493 B2
(45) **Date of Patent: *Mar. 10, 2020**

(54) ROOFING SHINGLE WITH ENHANCED SHADOWLINE APPEARANCE

(71) Applicant: CERTAINTEED CORPORATION, Malvern, PA (US)

(72) Inventors: Robert L. Jenkins, Honey Brook, PA (US); Gregory F. Jacobs, Oreland, PA (US)

(73) Assignee: CERTAINTEED CORPORATION, Malvern, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/019,566

(22) Filed: Feb. 9, 2016

(65) Prior Publication Data

US 2016/0160505 A1 Jun. 9, 2016

Related U.S. Application Data

(63) Continuation of application No. 14/136,542, filed on Dec. 20, 2013, now Pat. No. 9,290,942.

(60) Provisional application No. 61/748,790, filed on Jan. 4, 2013.

(51) Int. Cl.

| | |
|---|---|
| ***E04D 1/26*** | (2006.01) |
| ***E04D 1/22*** | (2006.01) |
| ***E04D 1/12*** | (2006.01) |

(52) U.S. Cl.

CPC ..... *E04D 1/22* (2013.01); *E04D 1/12* (2013.01); *E04D 1/26* (2013.01)

(58) Field of Classification Search

CPC ..... E04D 1/26; E04D 2001/005; Y10T 428/24372; Y10T 428/2438

See application file for complete search history.

(56) References Cited

U.S. PATENT DOCUMENTS

| | | | | |
|---|---|---|---|---|
| 1,911,014 | A * | 5/1933 | Cowan | E04F 13/147 52/555 |
| 2,089,312 | A | 8/1937 | Topping | |
| 2,199,760 | A * | 5/1940 | Sehuetz | E04D 1/265 52/555 |
| 2,205,679 | A | 6/1940 | Ames, Jr. | |
| 2,335,493 | A | 11/1943 | Drinkall | |
| 2,977,924 | A | 4/1961 | Bender | |
| 3,468,092 | A | 9/1969 | Chalmers | |
| 4,352,837 | A | 10/1982 | Kopenhaver | |
| D313,658 | S | 1/1991 | Noone | |
| 5,181,361 | A | 1/1993 | Hannah | |
| D344,144 | S | 2/1994 | Weaver et al. | |
| 5,287,669 | A | 2/1994 | Hannah | |

(Continued)

*Primary Examiner* — Brian E Glessner
*Assistant Examiner* — Daniel J Kenny
(74) *Attorney, Agent, or Firm* — Abel Schillinger, LLP; Thomas H. Osborn

(57) ABSTRACT

A roofing shingle may include a shingle body having a buttlap portion with a butt edge and a headlap portion. An exposure zone may extend from the butt edge toward the headlap portion and may be configured to be exposed to the environment when the roofing shingle is installed on a roof. The butt edge may be variegated and may include at least one tab. A first shadowline may be on at least a portion of the at least one tab. A second shadowline may be in the exposure zone. The first and second shadowlines may differ from each other in at least one aspect.

18 Claims, 16 Drawing Sheets

(56) References Cited

U.S. PATENT DOCUMENTS

| | | | | |
|---|---|---|---|---|
| 5,347,785 | A | 9/1994 | Terrenzio | |
| 5,375,387 | A | 12/1994 | Davenport | |
| 5,375,491 | A | 12/1994 | Hannah | |
| 5,421,134 | A | 6/1995 | Hannah | |
| 5,426,902 | A | 6/1995 | Stahl | |
| D369,421 | S | 4/1996 | Kiik et al. | |
| 5,660,014 | A | 8/1997 | Stahl | |
| 6,014,847 | A | 1/2000 | Phillips | |
| 6,190,754 | B1 | 2/2001 | Bondoc | |
| 6,212,843 | B1 | 4/2001 | Kalkanoglu | |
| 6,289,648 | B1 | 9/2001 | Freshwater | |
| 6,361,851 | B1 | 3/2002 | Sieling | |
| D466,629 | S | 12/2002 | Phillips | |
| 6,692,608 | B2 | 2/2004 | Phillips | |
| 6,748,714 | B2 | 6/2004 | Elliott | |
| 6,933,037 | B2 | 8/2005 | McCumber | |
| D610,720 | S * | 2/2010 | Elliott | D25/139 |
| 7,665,261 | B2 | 2/2010 | Elliott | |
| 9,212,487 | B2 * | 12/2015 | Kiik | E04D 1/26 |
| 2004/0079042 | A1 | 4/2004 | Elliott | |
| 2012/0260597 | A1 | 10/2012 | Jenkins | |
| 2014/0193604 | A1 | 7/2014 | Jenkins | |

* cited by examiner

ROOFING SHINGLE WITH ENHANCED SHADOWLINE APPEARANCE

CROSS-REFERENCE TO RELATED APPLICATION(S)

This continuation application claims priority to and the benefit of U.S. patent application Ser. No. 14/136,542, filed Dec. 20, 2013, which claims priority to U.S. Provisional Application No. 61/748,790, filed on Jan. 4, 2013, entitled "Roofing Shingle With Enhanced Shadowline Appearance" naming inventors Robert L Jenkins and Gregory F. Jacobs, both of which are incorporated by reference herein in their entirety.

BACKGROUND OF THE INVENTION

Field of the Disclosure

The present invention relates in general to roofing shingles and, in particular, to a system, method and apparatus for a roofing shingle with an enhanced shadowline appearance.

Description of the Related Art

In the art of shingle and siding manufacture, it is known to manufacture shingles of an asphalt impregnated organic or inorganic web, having granules on an outer surface thereof, and having smaller particles on an opposite surface, comprising complete layers of shingle material, examples of which are present in U.S. Pat. Nos. 4,352,837; 5,181,361; 5,287,669; 5,347,785; 5,375,491; 5,421,134; 5,426,902, as well as many other patents. Sometimes, these shingles are comprised of a plurality of complete layers of shingle material, adhered together as a laminate, and sometimes they are comprised of a single complete layer of shingle material, with or without an overlay comprised of an additional layer of adhesive, and an additional layer of granules applied thereto. In addition to structures such as the above identified shingles functioning as shingles, sometimes similar structures are used to function as components of siding, to be applied to side walls of a building structure, rather than the roof of a building structure. Accordingly, improvements in the appearance of roofing shingles continue to be of interest.

SUMMARY

Embodiments of a system, method and apparatus for a roofing shingle may comprise a shingle body having a buttlap portion with a butt edge and a headlap portion. An exposure zone may extend from the butt edge toward the headlap portion and may be configured to be exposed to the environment when the roofing shingle is installed on a roof. The butt edge may be variegated and may include at least one tab. A first shadowline may be on at least a portion of the at least one tab. A second shadowline may be in the exposure zone. The first and second shadowlines may differ from each other in at least one aspect.

In other embodiments, an array of roofing shingles may have a first course underlying a second course on a roof. Each roofing shingle may comprise a shingle body having a buttlap portion with a butt edge and a headlap portion. An exposure zone may extend from the butt edge toward the headlap portion and may be exposed to the environment. The butt edge may be variegated and may include at least one tab. A first shadowline may be on at least a portion of the at least one tab. A second shadowline may be in the exposure zone. The first and second shadowlines may differ from each other in color. The second shadowline of the first course may at least partially underlie the at least one tab of the second course, such that the second shadowline may be at least partially exposed even when at least partially covered by the at least one tab of the second course.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
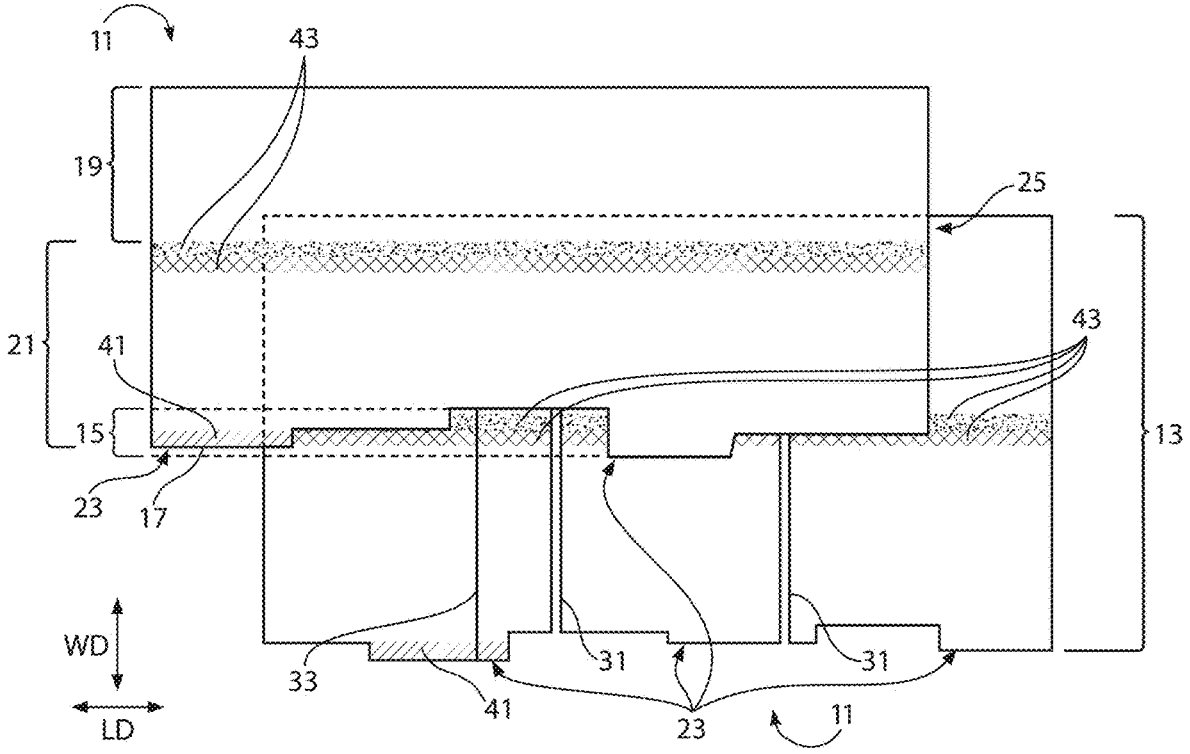
FIGS. 1-3 are plan views of embodiments of two courses of roofing shingles.
Figure 2:
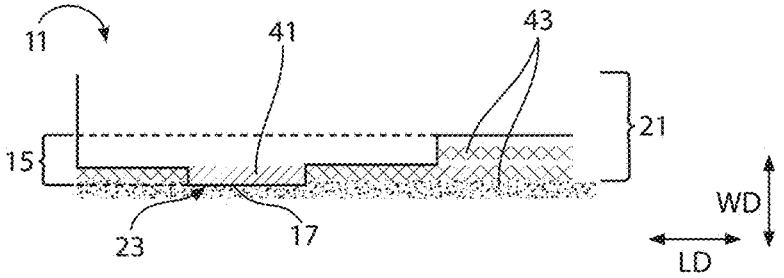
Figure 3:
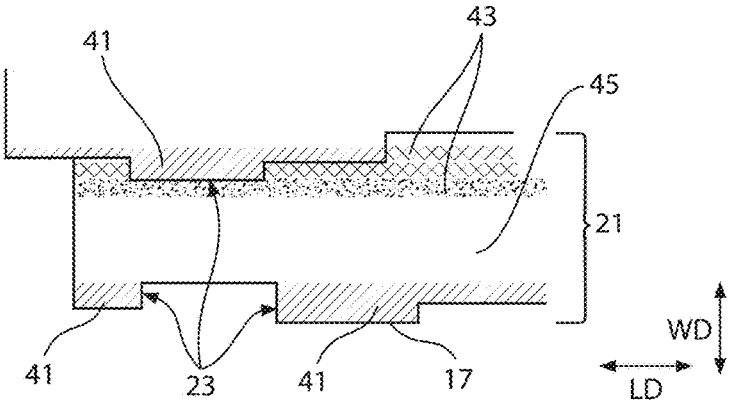

As shown in FIGS. 1-3, embodiments of a roofing shingle 11 may comprise a shingle body 13 that may be formed from a material that is bituminous, thermoplastic, thermoset polymer, metallic, recycled material or a combination thereof. The shingle body 13 may include a buttlap portion 15 with a butt edge 17 and a headlap portion 19. An exposure zone 21 may extend in a width direction WD from the butt edge 17 toward the headlap portion 19. The exposure zone 21 is configured to be exposed to the environment when the roofing shingle 11 is installed on a roof (see, e.g., FIGS. 4 and 5). In this disclosure, the term "buttlap portion" 15 may be defined in some embodiments as a subset of the exposure zone 21, such that it represents the width range over which the butt edge 17 may vary. In addition, the shingle body 13 may comprise one layer, or more than one layer in the exposure zone 21, and each layer may be either continuous or discontinuous.

Embodiments of the butt edge 17 are variegated as opposed to conventional dragon's tooth designs, which are typically symmetrical. The term "variegated", as used herein, refers to an irregular edge that is non-symmetrical, asymmetrical, and which may have multiple or variable widths (e.g., 4 different widths in the width direction). Variegated butt edges 17 may be rectilinear, non-linear, or not co-linear and include at least one tab 23. In some embodiments, the variegated butt edge 17 is discontinuous and is not dragon toothed. Moreover, the variegated butt edge 17 may include a single layer, or a laminate composed of more than one layer. For example, U.S. Pat. App. Pub. 2012/0260597, published Oct. 18, 2012, discloses some laminated roofing products, and is incorporated herein by reference in its entirety.

Unlike the widths of some embodiments of variegated butt edges 17, the widths of dragons teeth are as wide as the exposure zone 21, and can extend adjacent the fastening zone 25 in the headlap portion 19. Thus, the variegated butt edge 17 may have a width that is less than a width of the exposure zone 21, such that the variegated butt edge 17 does not extend to the fastening zone 25 in the headlap portion 19. Thus, the term "variegated" may include a width that is less than that of the exposure zone 21, does not extend to the fastening zone 25, and only varies in width from the butt edge 17 by about +/−5% to about +/−25%. These percentage variances may reflect a measurement relative to an entire width of the exposure zone 21 (i.e., as a percentage of the exposure zone 21), or as a percentage variance from a nominal width measurement of the butt edge 17.

Embodiments of the variegated butt edge 17 may vary in width by at least about 2%. For example, variegated butt edge widths may vary by at least about 5%, such as at least about 8%, or even at least about 10%. In other embodiments, the variegated butt edge may vary in width by not greater than about 25%, such as not greater than about 20%, not greater than about 15%, or even not greater than about 12%. The width of the variegated butt edge 17 also may be in a range between any of the preceding minimum and maximum values.

In some embodiments, the variegated butt edge 17 may be interrupted by at least one cut out 31, slot or slit 33, such that the variegated butt edge 17 may be sectioned into smaller portions or partial portions to define a plurality of tabs 23. In other embodiments, the variegated butt edge 17 does not have cut outs, slots or slits, and is not sectioned or interrupted into smaller portions either wholly or partially by such features. In addition, the variegated butt edge 17 may have at least one edge portion that is straight, curved or has other geometric shape, profile or design, or is a combination of multiple geometric shapes.

Embodiments of the roofing shingle 11 also may comprise a first shadowline 41 on at least a portion of the at least one tab 23, and a second shadowline 43 in the exposure zone 21. The first and second shadowlines 41, 43 may differ from each other in at least one aspect.

For example, the at least one aspect may be color variation, coatings, density, embedment, size or shape of the granules, etc. In some embodiments, the first and second shadowlines 41, 43 may differ from each other in color by at least about 2 L*CIE color units, such as at least about 5 L*CIE color units, at least about 10 L*CIE color units, or even at least about 15 L*CIE color units. In other versions, the first and second shadowlines 41, 43 may differ from each other in color by not greater than about 50 L*CIE color units, such as not greater than about 40 L*CIE color units, not greater than about 30 L*CIE color units, or even not greater than about 20 L*CIE color units. The color variation also may be in a range between any of the preceding minimum and maximum values. The color measurement L* may be obtained with, for example, a Hunter LabScan instrument with a 0°/45° geometry and a 2° standard observer and source C illuminant.

In some embodiments, at least one of the shadowlines is discontinuous or interrupted in at least one of a width direction and a length direction. For example, at least a portion of at least one shadowline 41, 43 may be interrupted at the variegated butt edge 17 of an adjacent course of roofing shingle 11. The first and second shadowlines 41, 43 may have a same width, or different widths. One or more of the shadowlines 41, 43 may be continuous and oscillate or vary in width in a length direction LD for at least one roof shingle 11 in a course of more than one roofing shingle 11. In other versions, a same shadowline tone or color may be repeated with either a darker or lighter color tone as a separation therebetween in the length direction LD. More than one shadowline 41, 43 may vary in color and go from darker to lighter, or lighter to darker, in the width direction WD.

The second shadowline 43 may be positioned to at least partially underlie the at least one tab 23 of a subsequent course of roofing shingle 11. For example, the second shadowline 43 may be at least partially exposed even when at least partially covered by the at least one tab 23 of the subsequent course of roofing shingle 11.

In addition, the second shadowline 43 may comprise a plurality of second shadowlines 43 (e.g., two shown) in the exposure zone 21. Each of the second shadowlines 43 may vary in at least one aspect with respect to the other second shadowlines 43. Likewise, the first shadowline 41 may comprise a plurality of first shadowlines 41 on the at least one tab 23. Each of the first shadowlines 41 may vary in at least one aspect with respect to the other first shadowlines 41.

In some embodiments, the second shadowline 43 may be located in the headlap portion 19 (FIG. 1). In some versions, the second shadowline 43 may be formed from the same material as the headlap portion 19. Embodiments of the second shadowline 43 may be visible as shown and/or through one or more of the cut outs 31 of a subsequent course of roofing shingles 11.

The plurality of second shadowlines 43 may be configured to underlie the at least one tab 23 of a subsequent course of roofing shingle 11. The roofing shingle 11 may further comprise a color separation or space 45 (FIG. 3) between at least some of the plurality of second shadowlines 43 in a color similar to a primary blend or a complementary color of the roofing shingle 11.

The at least one tab 23 may comprise a plurality of tabs 23 with varying widths that are configured to at least partially cover the second shadowline 43 of a previous course of roofing shingle 11 by different amounts, as shown. Thus, at least one of the plurality of second shadowlines 43 may be configured to at least partially underlie at least one of the plurality of tabs 23 of a subsequent course of roofing shingle 11.

In addition, the plurality of tabs 23 may comprise differing tab widths with one or more variegated or discontinuous lower edge profiles 17 on individual ones of the plurality of tabs 23. In FIG. 3, for example, the uppermost tab 23 has a lower edge that overlies only one of the second shadowlines 43, and is located at the intersection between the two second shadowlines 43. However, the lower edge may terminate in the upper second shadowline 43, in the lower second shadowline 43, or extend beyond the lower second shadowline 43 even further into the color separation or space 45.

In still other embodiments, the exposure zone 21 may comprise a primary shingle color that is of a blend of two or more different colored blend drops or tones, with or without a mix or a single granule color tone or two or more mixed individual granule color. The second shadowline 43 may be located at an upper end of the exposure zone 21 adjacent the primary shingle color.

Figure 4:
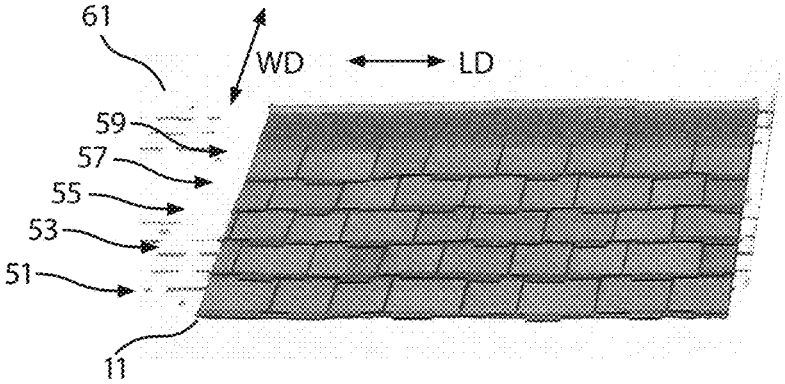
FIGS. 4 and 5 are top isometric views of embodiments of arrays of roofing shingles on a roof.
Figure 5:
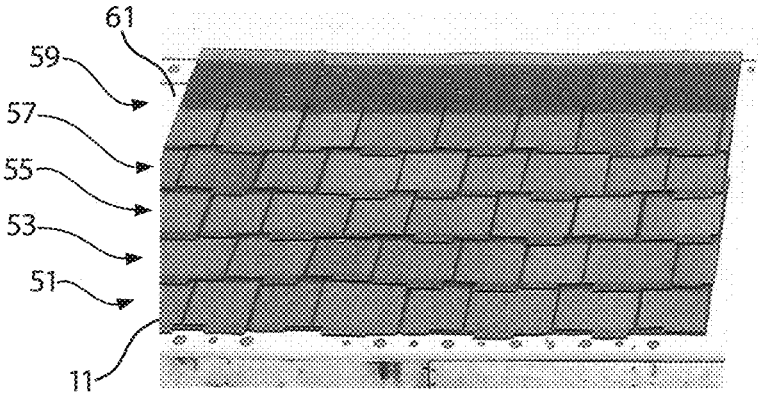

Referring now to FIGS. 4 and 5, embodiments of an array of roofing shingles 11 may have a plurality of courses, such as a first course 51 underlying a second course 53, which underlies a third course 55, which underlies a fourth course 57, which underlies a fifth course 59, etc., on a roof 61.

The roofing shingles 11 may comprise the various embodiments disclosed herein. For example, each roofing shingle 11 may have a shingle body 13 with a buttlap portion 15 and a butt edge 17, and a headlap portion 19. An exposure zone 21 may extend from the butt edge 17 toward the headlap portion 19 and is exposed to the environment. The butt edge may be variegated and include at least one tab 23. A first shadowline 41 may be on at least a portion of the at least one tab 23. A second shadowline 43 may be in the exposure zone 21. The first and second shadowlines 41, 43 may differ from each other in color. The second shadowline 43 of the first course 51 may at least partially underlie the at least one tab 23 of the second course 53, such that the second shadowline 43 is at least partially exposed even when at least partially covered by the at least one tab 23 of the second course 53.

A plurality of second shadowlines 43 may be on the first course 51 and underlie the at least one tab 23 of the second course 53. The array may further comprise a color separation or space between at least some of the plurality of second shadowlines 43 in a color similar to a primary blend or a complementary color of the roofing shingles 11. The at least one tab 23 may comprise a plurality of tabs 23 with varying widths that at least partially cover the second shadowlines 43 of the first course 51 by different amounts. At least a portion of at least one shadowline 41, 43 may be interrupted at the variegated butt edge 17 of an adjacent course of roofing shingle 11.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

Embodiments of a system, method and apparatus for roofing shingle are disclosed. For example, a roofing shingle 601 (FIG. 6) may comprise a plurality of strata 603, 605, 607, 609 (four shown) stacked and laminated together by adhesive 611. Each of the strata may have a strata width SW that differs from the other strata.

Figure 7:
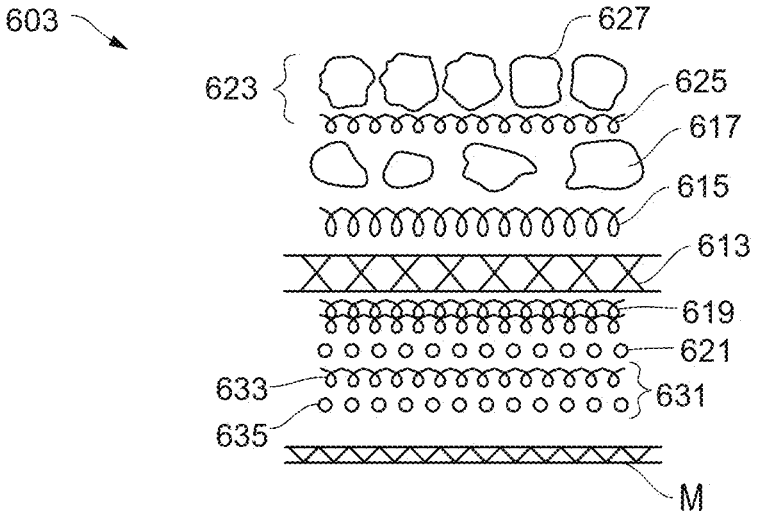
FIG. 7 is a schematic, exploded sectional side view of an embodiment of a strata.

As shown in FIG. 7, each of the strata may comprise a plurality of layers. For purposes of this invention, a stratum may comprise two or more layers of different materials. For example, the layers may comprise a substrate 613, a top asphalt layer 615 on top of the substrate 613, granular matter 617 on the top asphalt layer 615, a bottom asphalt layer 619 on a bottom of the substrate 613, and mineral matter 621 on the bottom asphalt layer 619. The various strata may have identical compositions or different compositions. Although four strata are shown, the roofing shingle may comprise three to five strata in some embodiments, or more than five strata in other embodiments.

The strata have a strata length SL (FIG. 8) that is transverse to the strata width SW (FIG. 6) of each respective strata. Each layer of each strata may extend across an entirety of the strata length SL, other than cut outs CO, which are described elsewhere herein. Alternatively, the layers within the strata may vary in layer length and not extend for the entire strata length SL. In some embodiments, at least one of the strata is inverted such that layers of the inverted strata are reversed (e.g., vertically) relative to layers of another one of the strata.

Again referring to FIGS. 6 and 7, other embodiments may further comprise at least one overlay 623 on at least one of the strata 603, 605, 607, 609. Each overlay 623 may comprise an additional asphalt layer 625 (FIG. 7) on the granular matter 617, and additional granular matter 627 on the additional asphalt layer 625. The overlay 623 may be present on at least one strata 605, 607, 609 that underlies the uppermost strata 603. In other embodiments, a plurality of overlays may be stacked on each other. The overlay 623 may have an overlay length OL (FIG. 8) that is equal to or less than a strata length SL on a respective one of the strata. The overlay may be evenly applied or applied to form a tapered wedge when viewed in section from the side of the shingle.

Any of these embodiments may further comprise at least one underlay 631 (FIGS. 6 and 7) on at least one of the strata. Each underlay 631 may comprise an additional asphalt layer 633 on the mineral matter 621, and additional granular matter or additional mineral matter 635 on the additional asphalt layer 633. The underlay 631 may be present on at least one strata 605, 607, 609 that underlies the uppermost strata 603, and/or on the uppermost strata 603 as well. A plurality of the underlays 631 may be stacked on each other. The underlay 631 may have an underlay length UL (FIG. 8) that is equal to or less than a strata length SL on a respective one of the strata. The underlay may be evenly applied or applied to form a tapered wedge when viewed in section from a side of the shingle.

Figure 6:
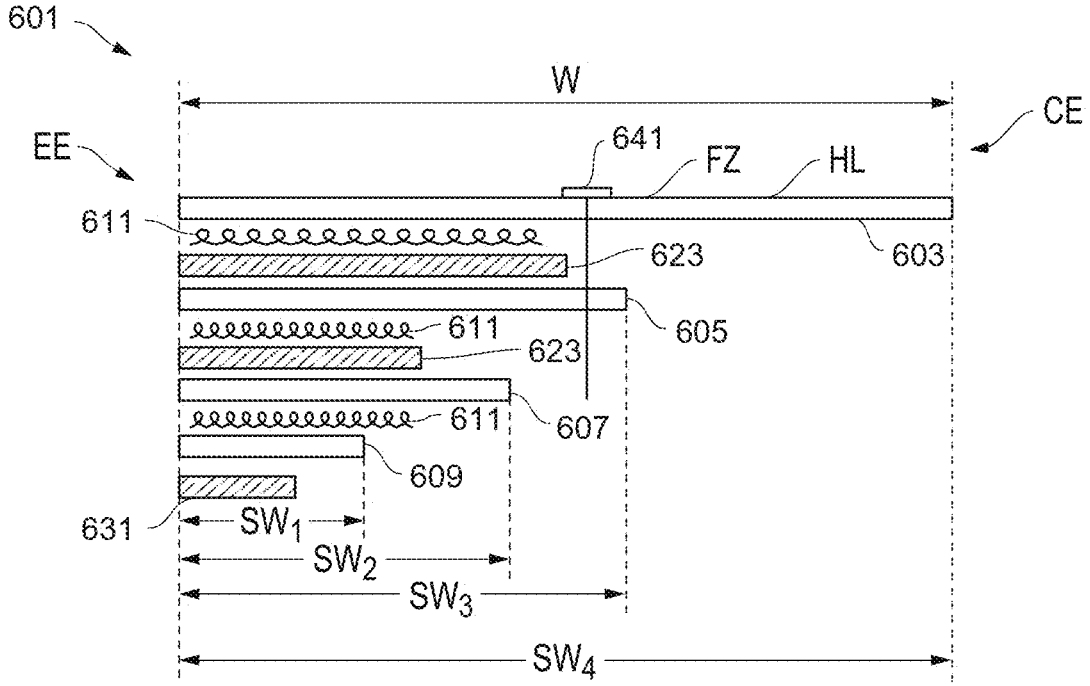
FIG. 6 is an exploded schematic side view of an embodiment of a shingle having a plurality of strata.
Figure 8:
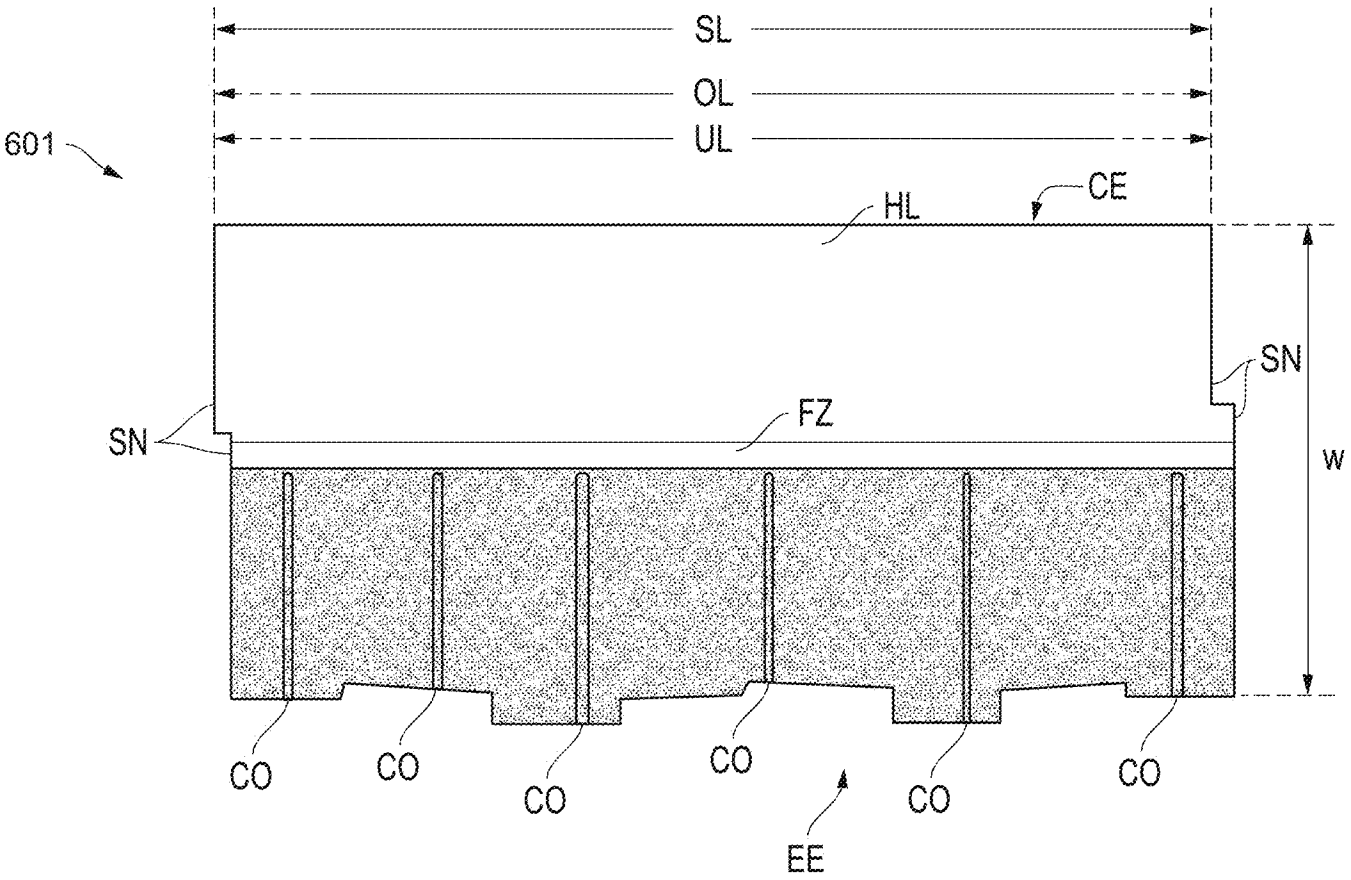
FIG. 8 is a top view of an embodiments of a final individual shingle.
Figure 9:
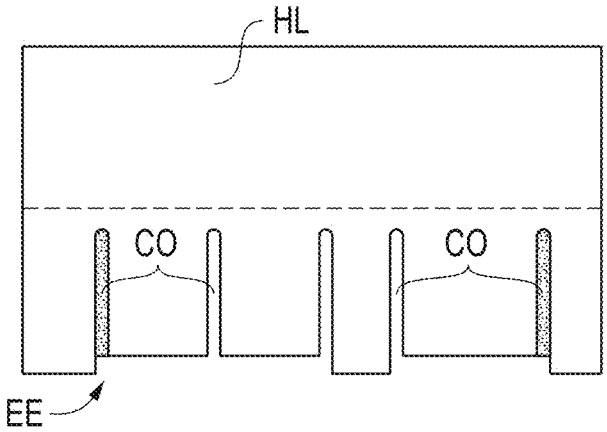
FIGS. 9-11 are top view of embodiments of shingles.
Figure 10:
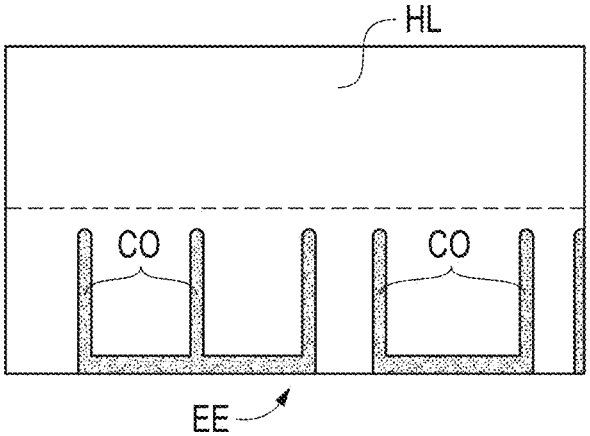
Figure 11:
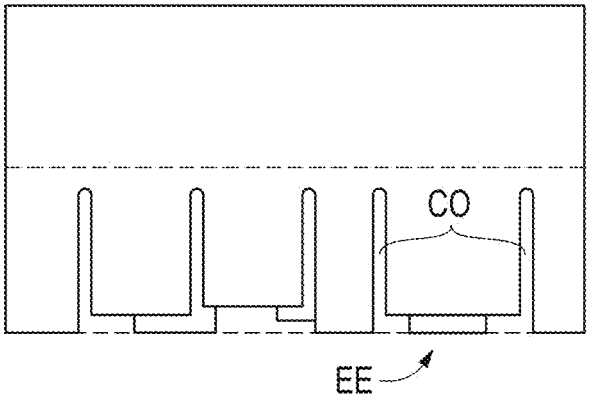

As shown in FIGS. 6 and 8, the roofing shingle 601 has an exposed edge EE and a covered edge CE. A width W of the roofing shingle extends between the exposed edge EE and the covered edge CE. Likewise, the strata 603, 605, 607, 609 have strata exposed edges that are substantially aligned with the exposed edge EE (FIG. 6). The strata may be vertically arrayed in strata width SW from a greatest strata width at a top of the roofing shingle 601, to a least strata width at a bottom of the roofing shingle, such that the strata form a tapered lower surface in the width W direction on the roofing shingle.

As shown in FIGS. 6 and 8-11, the exposed edge EE may be straight (FIG. 6), or have at least some tabs that are angled, staggered or varied in shape or dimension. For example, a lower most one of the strata 609 (FIG. 6) may have a straight exposed edge EE (FIG. 10) that aligns with at least one other exposed edge of another strata.

The roofing shingle 601 may further comprise cut outs CO that extend from the exposed edge EE toward a headlap HL of the roofing shingle. The cut outs CO may vary in width and length. The cut outs CO may be formed only in an uppermost one 603 of the strata. The cut outs CO may be formed in at least two of the strata (FIG. 6) including the uppermost one of the strata. The cut outs CO may be nonaligned with the tabs formed in at least one of the strata as shown in FIG. 8.

Figure 12:
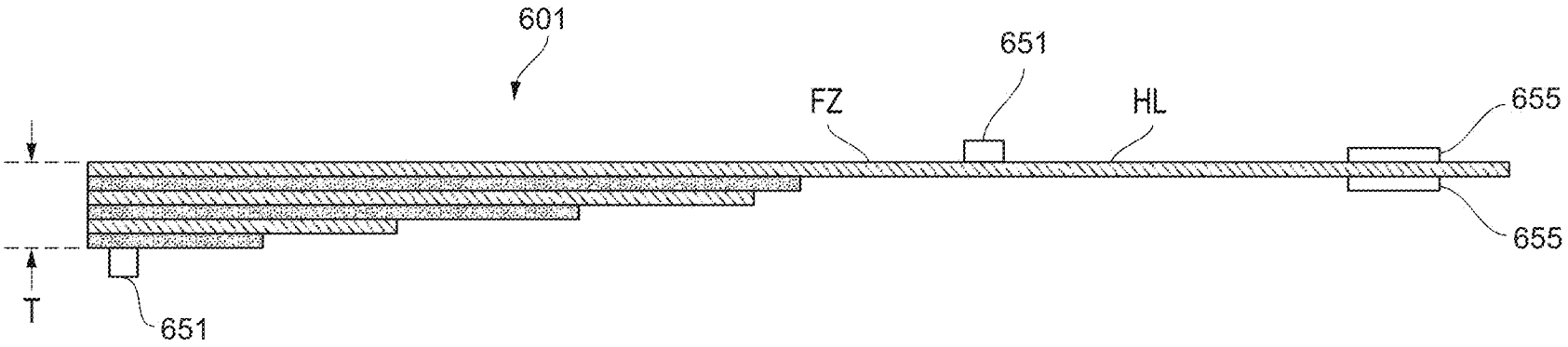
FIG. 12 is a sectional side view of an embodiments of a shingle.

As shown in FIG. 6, fasteners 641 are adapted to extend through at least two of the uppermost ones 603, 605 of the strata in a fastener zone FZ (FIG. 8). Some embodiments further comprise a sealant 651 (FIG. 12) on at least one of the strata, and a release layer 655 on at least one of the strata. For example, the sealant 651 may be on at least one of a lowermost one 609 of the strata and an uppermost one 603 of the strata, and the release layer 655 may be on at least one of a lower surface and an upper surface of a headlap HL of the uppermost one 603 of the strata. Alternatively, a release layer on one shingle may be provided and aligned with the sealant on another shingle when the shingles are stacked in a bundle so that they do not stick together in a package.

In some embodiments, the roof shingle has a length SL (FIG. 8) with a thickness T (FIG. 12) that varies across the length. At least some of the layers (any component, element or portion; e.g., the adhesive, sealant, overlays or underlays) may be discontinuous in the length direction (e.g., SL, OL, UL, etc. in FIG. 8). The roof shingle's width SW (FIG. 6) also may have a thickness that varies in the width direction.

In some embodiments, the substrate 613 (FIG. 7) may comprise a fiberglass mat, polyester, organic felt or fiberglass polyester composite mat. The mineral matter 621 may comprise fine materials selected from the group consisting of sand, talc, powdered limestone, mineral granule fines, slate fines, slag fines, vitrified material fines, recycled mineral matter fines, or other non-mineral matter fines comprising polymeric, plastic or recycled polymer materials; or coarse materials selected from the group consisting of granular sand, talc, mineral granules, slate granules, slag, granular vitrified materials, granular limestone, or other non-mineral matter material comprising polymeric, plastic or foam. Other embodiments further comprise at least one reinforcing mesh M in or on at least one of the strata.

Figure 13:
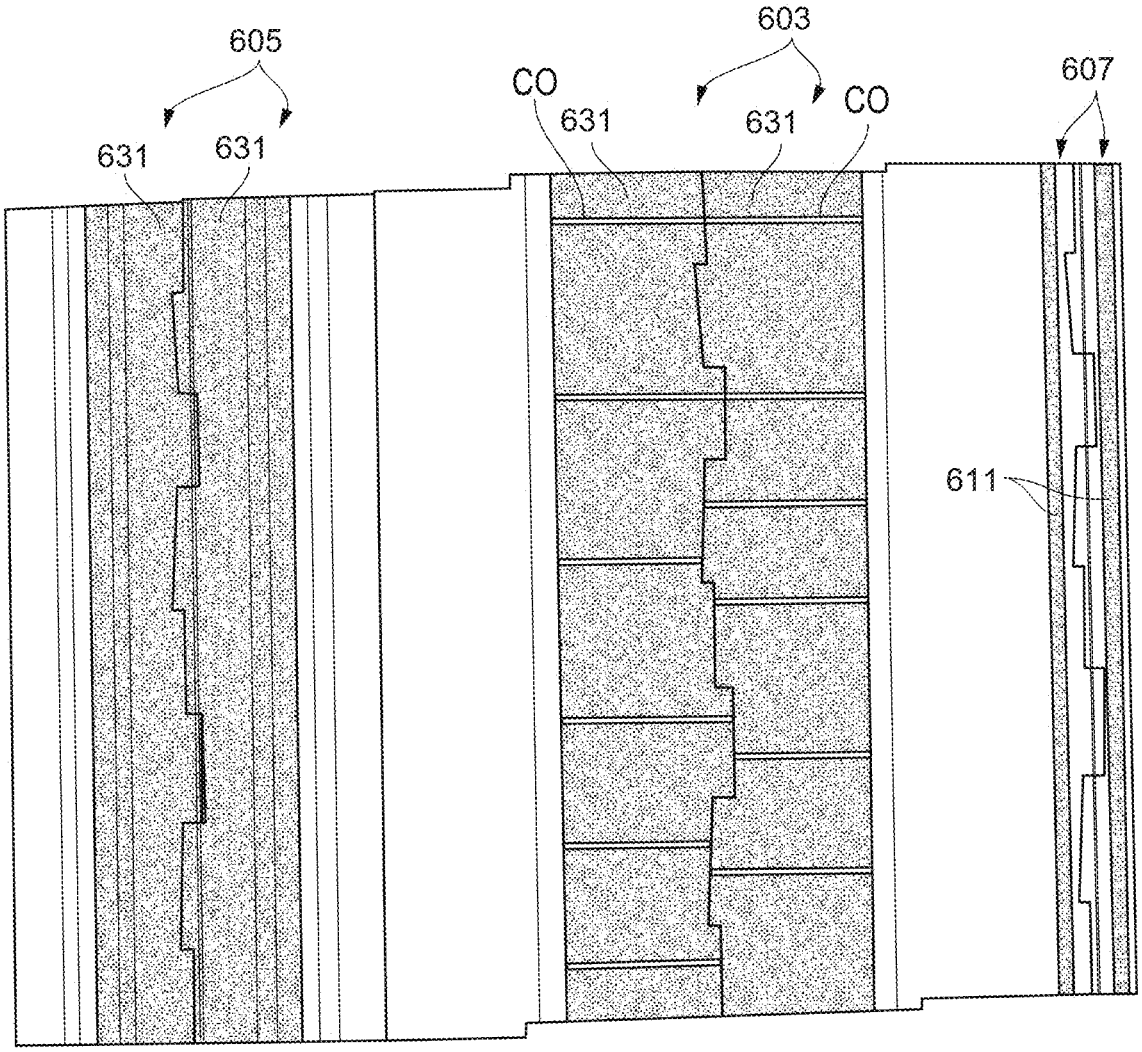
FIG. 13 is a top view of an embodiment of an overall sheet layout for production of a three strata roofing shingle.

Referring now to FIGS. 13-19, embodiments of a method or process of producing roofing shingles 601 are shown. FIG. 13 shows an overall sheet layout (before any cuts are made) for making a pair of "three strata" configurations from a single sheet of material. The single sheet initially comprises the raw substrate 613, which may be viewed in terms of "lanes" that will ultimately form the various strata. The cutouts CO are shown with the final shingle shape for reference purposes, but in actual production the final shape is formed in the last step before packaging. The cutouts CO are formed before the individual strata are combined on the production line. Prior to this step, any underlays 631 and/or overlays 623 are applied.

The left and middle shaded areas of FIG. 13 depicts where the underlays 631 may be applied when viewing through the sheet. The shading on the far right depicts the laminating adhesive 611 extending in the machine direction. The entire short width may have underlay 631 applied to it.

Figure 14:
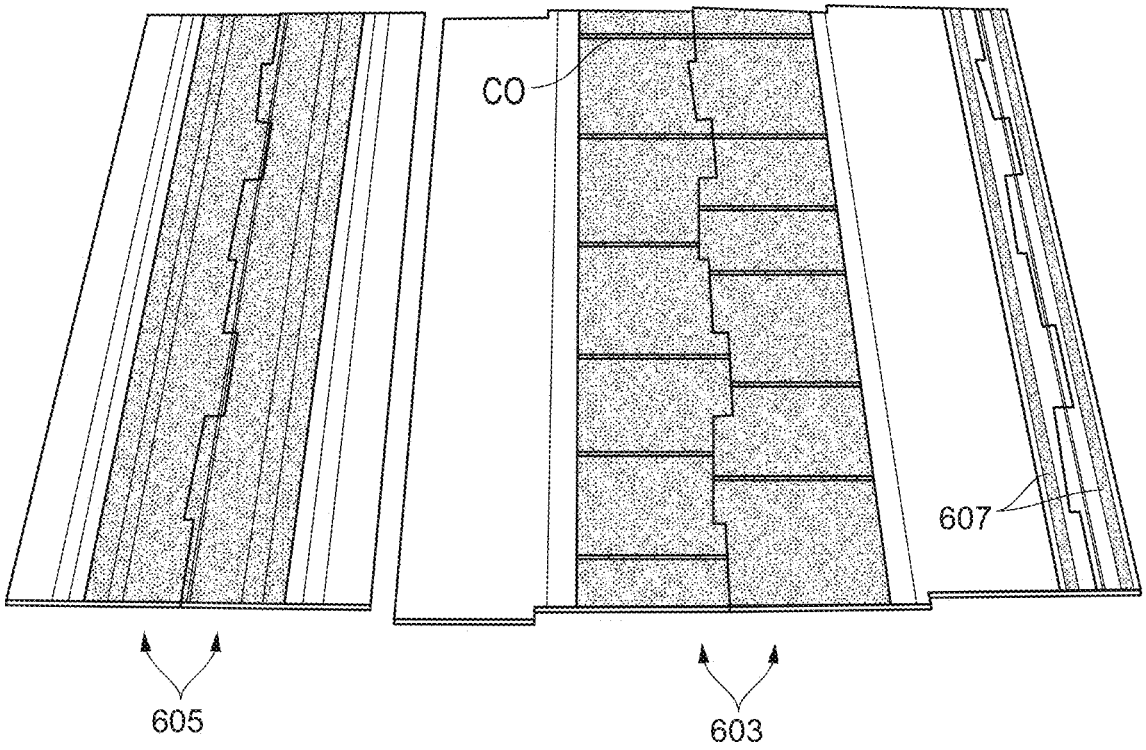
FIGS. 14-16 are sequential top views of embodiments of stages of assembly of the roofing shingle of FIG. 8.
Figure 15:
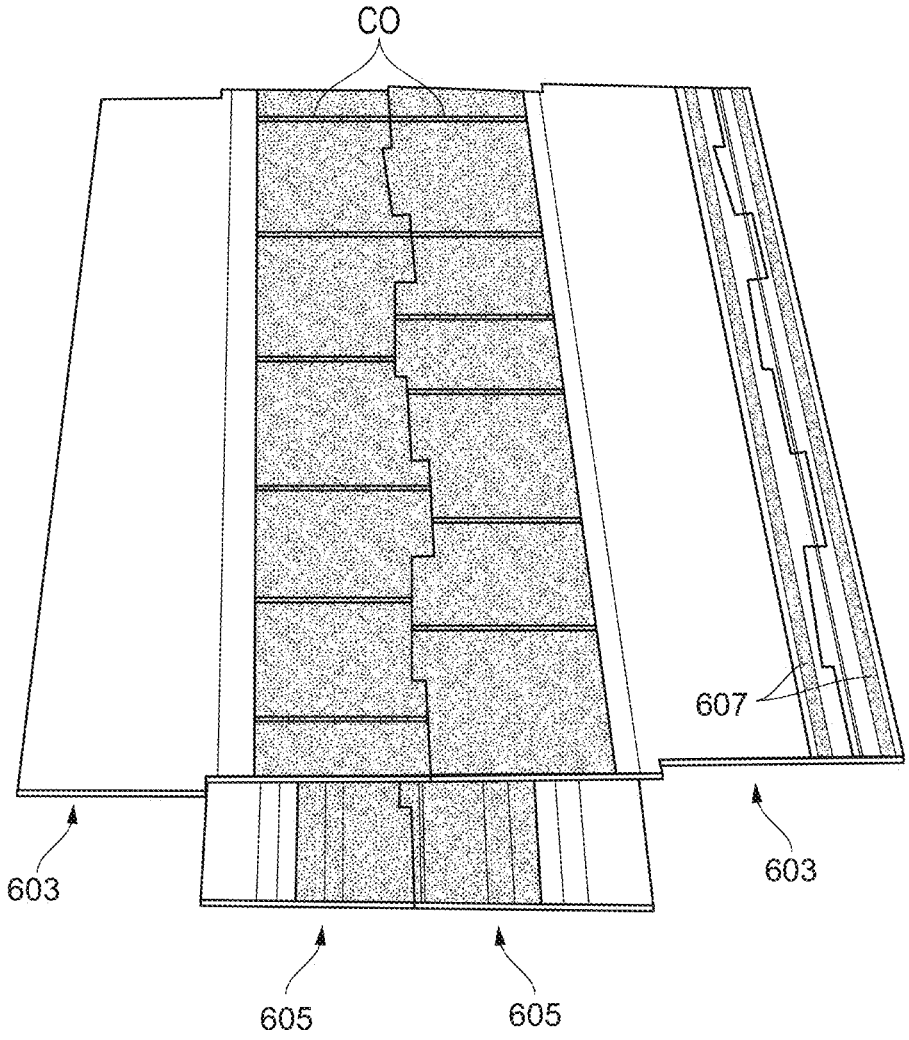
Figure 16:
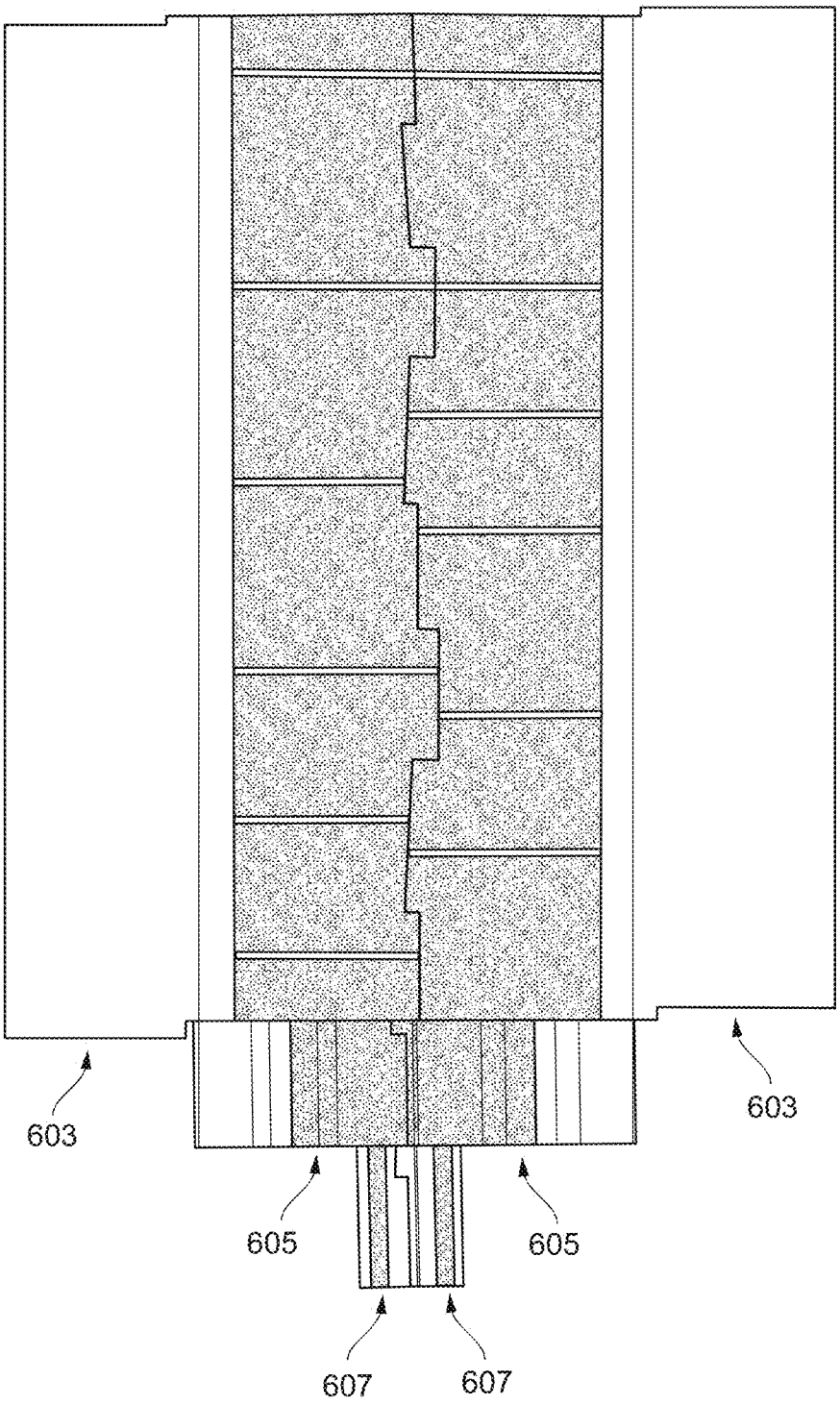

FIG. 14 shows the middle strata 605 cut from the main sheet body. They are placed under the top strata 603 (FIG. 15). The top two cutouts CO of FIG. 18 that directly oppose each other provide a synchronizing reference point that repeats every second shingle length in the final cut pattern. In an alternate embodiment (not shown), the synchronizing reference point repeats at a different, predetermined frequency that may be an integer number of shingle lengths in the pattern, or a predetermined frequency that includes a fractional shingle length aspect.

Figure 20:
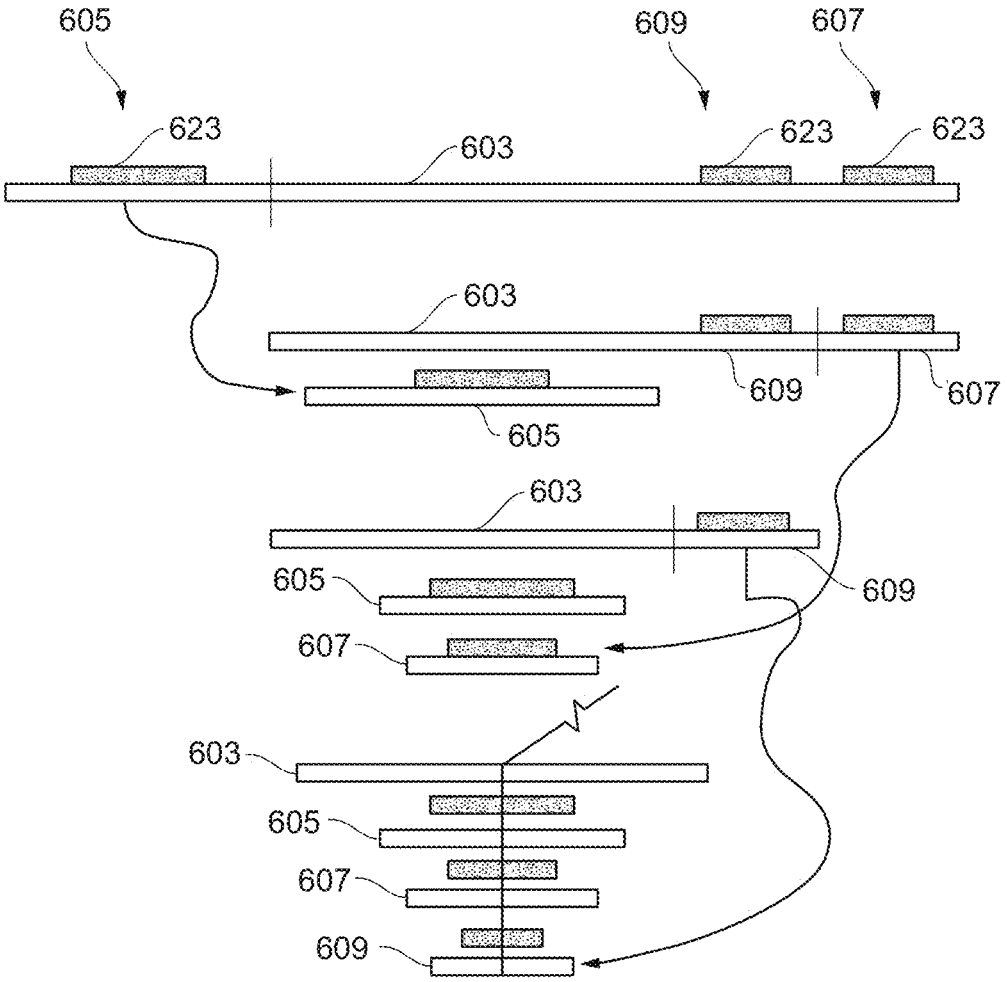
FIG. 20 is a schematic end view of an embodiment of a process for manufacturing a shingle.

Alternatively, an opposing set (i.e., left shingle to right shingle) of cutouts CO also may be used if a wider cutout width is used. In FIG. 15, the lowermost strata 607 are not yet cut from the sheet body, but are subsequently stacked and positioned beneath the top two strata 603, 605 (FIG. 16) as shown. FIG. 20 depicts a similar sequence of steps for forming, cutting and assembling embodiments of a pair of "four strata" shingles.

Figure 17:
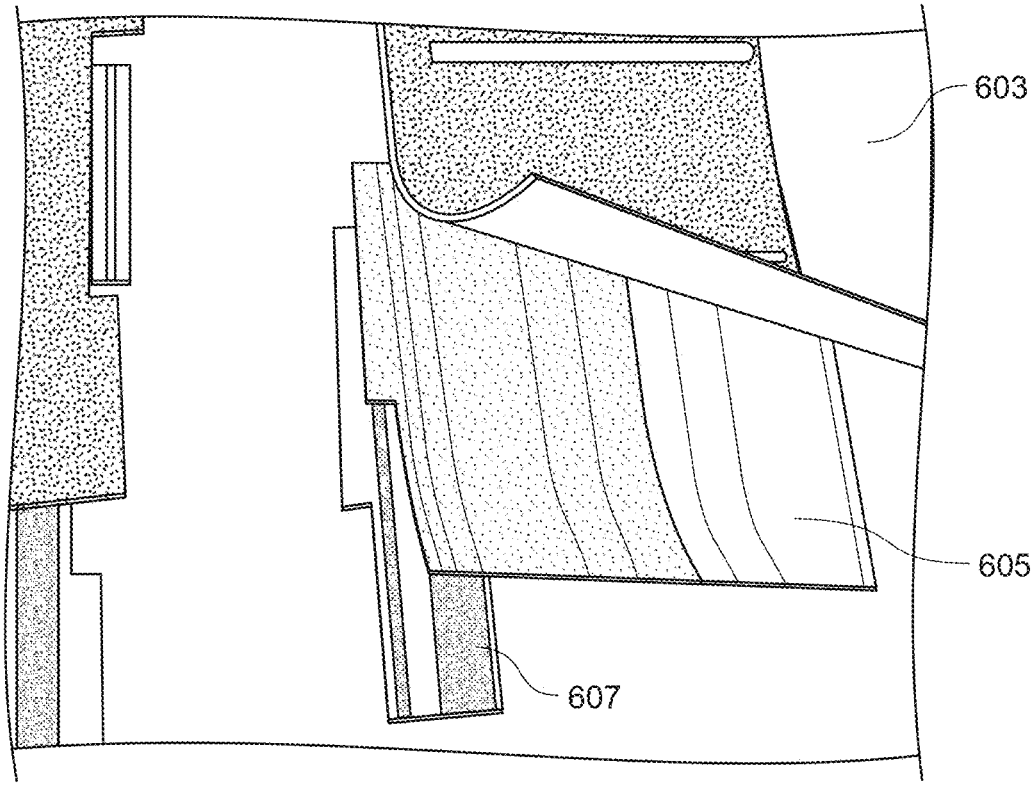
FIG. 17 is a top view of an embodiment of an assembly showing a three strata configuration and a layout of a laminating adhesive location.
Figure 18:
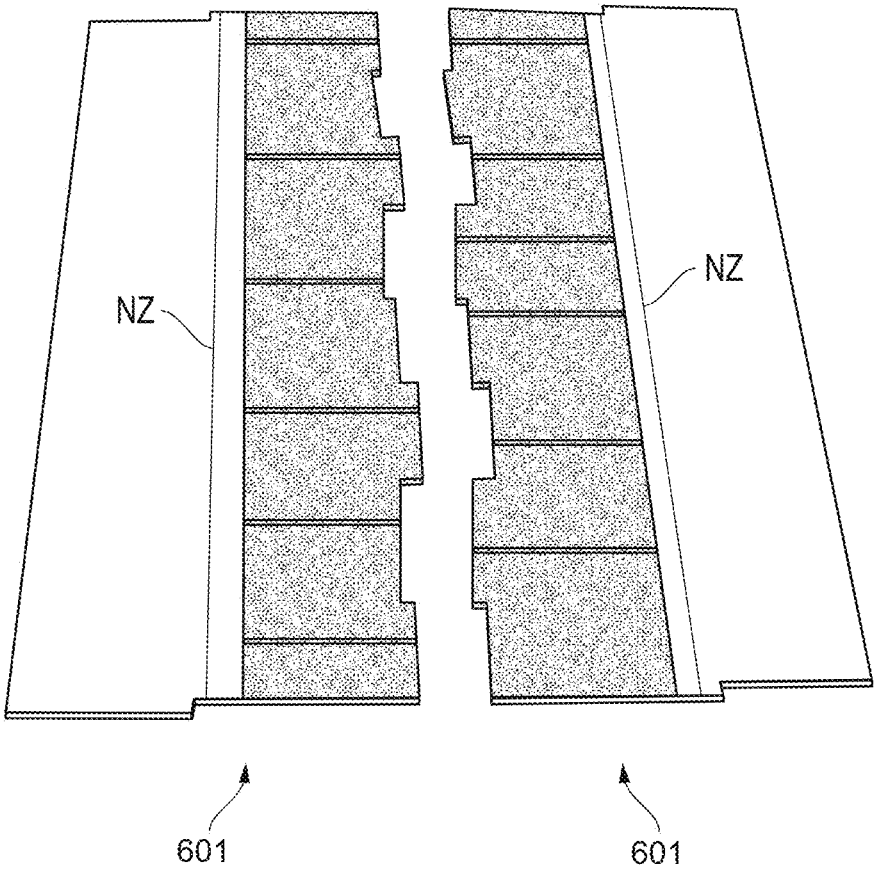
FIG. 18 is a top view of an embodiment of a final sheet cut of individual shingles that are paired apart after assembly.

FIG. 17 is a schematic view of an assembly of a three strata configuration and a layout of locations for laminating adhesive. FIG. 18 shows a final sheet cut for a pair of individual shingles 601 that are cut apart after assembly (underlying strata not shown). The nail zone NZ locations extend in the machine direction all the way to outside edges of the shaded area. Again, the shaded area depicts underlay 623 and is shown only for illustrative purposes and how it would appear if it were visible through the sheet.

Figure 19:
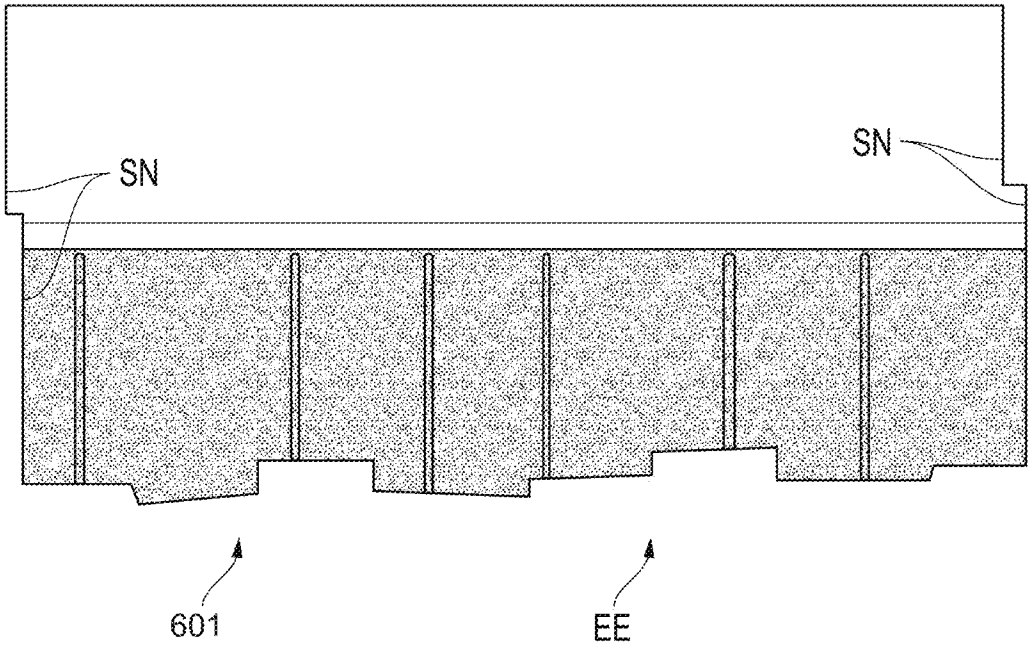
FIG. 19 is a top view of an embodiment of a final individual shingle of FIG. 13.

FIGS. 8 and 19 show schematic views of embodiments of the two, complementary-shaped shingles 601. Shingles 601 are shown with side notches SN that may be used for alignment during installation on the roof of a building. The exposed edge EE is illustrated with some lower edges tapered at an angle and some orthogonal or horizontal for desired aesthetics. The angles also have a functional feature in that they permit an aesthetic look of length variation, but allow cutting of the shingles more easily for separation. The angles and corners allow a more generous corner radius, which makes them easier to cut and tool, extends the life of tooling, is more production friendly, and runs faster. Although there are seven tabs shown on each shingle, another option is to have a combination of six and seven tabs for opposing shingles. A greater or lesser number of tabs for opposing shingles also may be provided depending on desired shapes and the length of the shingle.

The particular shingle pattern shown has opposing lanes where each lane goes into a separate package. When removed in reverse order from the package, the shingles may be applied in a step off application method (preferred by contractors) to provide a reasonably random appearance visually like a natural wood or cedar shake known in the roofing business. The appearance may be further enhanced by color contrast, shadowline and blending ratios of various granule colors together.

Figure 21:
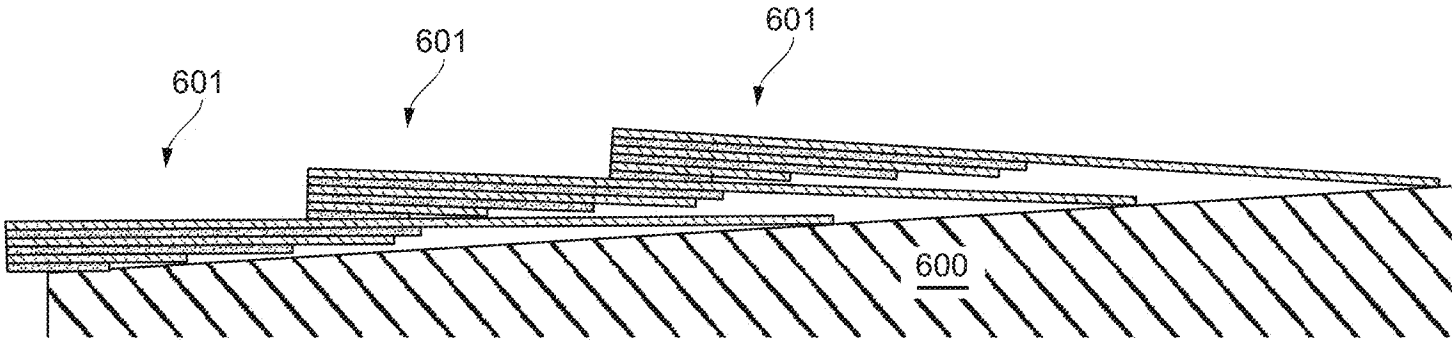
FIGS. 21 and 22 are sectional side and isometric views of embodiments of shingles installed on a roof of a building.
Figure 22:
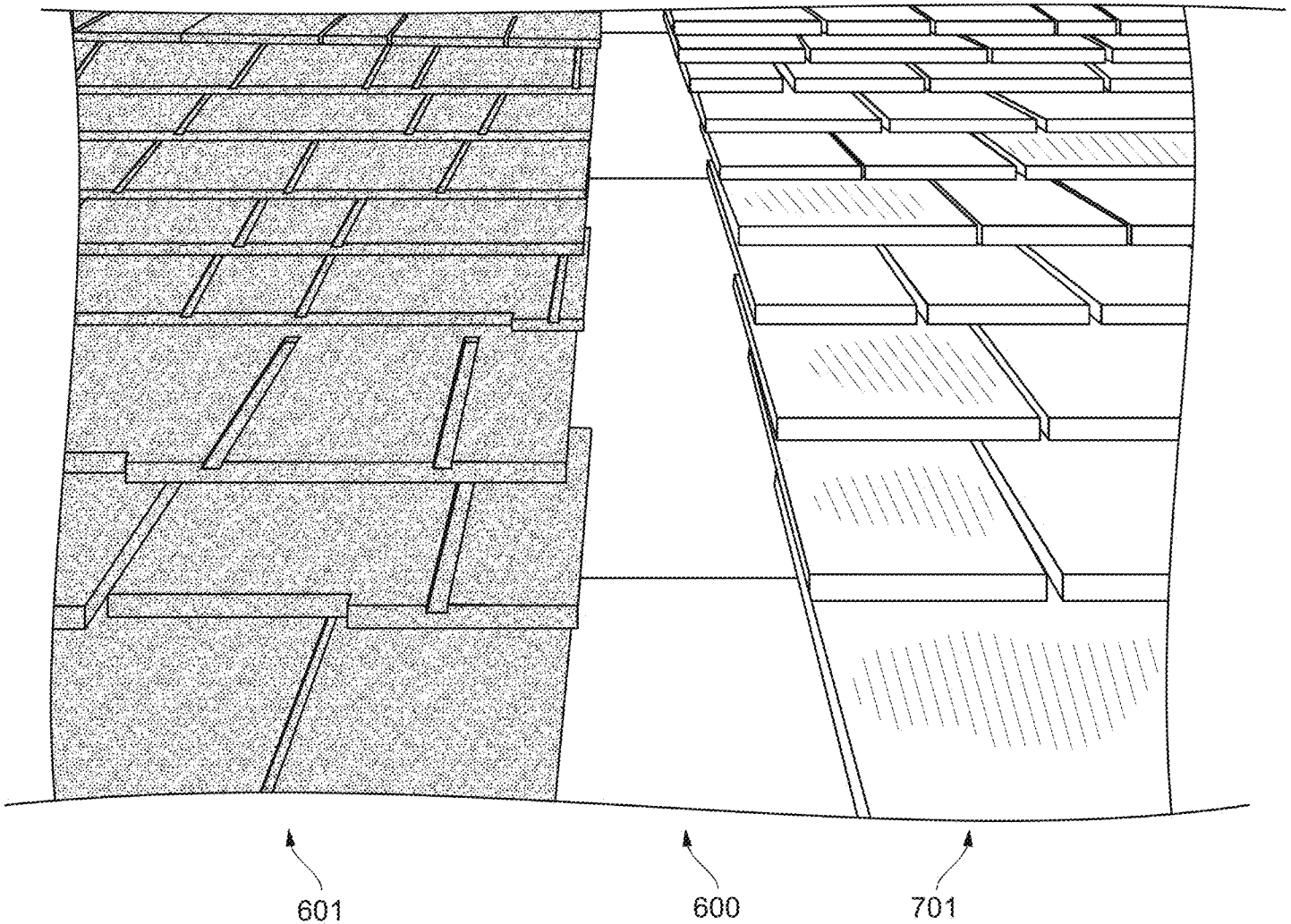

FIGS. 21 and 22 depict embodiments of shingles 601 installed on a building 600. FIG. 22 also illustrates conventional wood shake shingles 701 for comparison. Embodiments may include feature that allows at least two inches of headlap material overlap for every shingle within an installation on a roof, especially with regard to a variable width or uneven lower edge of the exposed portion.

In an overall finished shingle width design having an uneven lower exposed edge where the longest width dimension to the top headlap edge or non-exposed top edge from the exposure edge, the width may be two times the longest exposure height, plus two inches, plus the difference between the shortest and the average exposure heights.

For example, if the average exposure is 6½" and the exposure ranges from 6" to 7", then the total overall shingle width including the heights of longest exposure would result in 16½". Alternatively, if the average exposure is 6½" and the exposure ranges from 5½" to 7½", the total overall shingle width in the regions with the longest exposure zone would be 18" (i.e., 2×7.5+2+1).

In some embodiments, a roof of a building has shingles, and the shingles comprise a plurality of strata stacked and laminated together by adhesive. Each of the strata may have a strata width that differs from the other strata. Each of the strata may comprise a substrate; a top asphalt layer on top of the substrate; granular matter on the top asphalt layer; a bottom asphalt layer on a bottom of the substrate; and mineral matter on the bottom asphalt layer.

An advantage of using asphalt based shingle roofing products is lesser cost over more expensive but natural materials such as quarried slate or split wood or sawn shakes that have inherent and desired thickness. Traditional asphalt roofing products are much thinner and less in weight than natural materials. Asphalt shingles also simulate a plurality of pieces of natural materials within a single shingle, thus enabling faster, more efficient coverage of a roof area with fewer individual pieces.

The wedged shaped multilayer asphalt shingle described herein may use overlay technology and pre-designed laminated staggered layers to achieve the desired edge thickness and look of natural wood or sawn shakes while conserving material use and allowing efficient packaging to the job site. These shingles simulate the shape and appearance of real wood or sawn shakes in design and using granule color blending.

The shingle design is based in general on a typical asphalt sheet where a membrane of fiberglass mat or similar material is coated with an asphaltic material on the top and bottom sides and generally within the body of the membrane. Mineral granules that may be of various color combinations are typically added to the top surface and mineral matter such as sand is typically added to the bottom surface, but granular material may also be used by product design.

The coated asphalt sheet described above may be further processed so as to add an "overlaid" additional layer or layers of asphaltic material or the like on one or more portions or layers adhered together and generally mineral matter to pre-determined designated locations either the top surface (overlay) or bottom surface (underlay) or both top (overlay) and bottom (underlay) surfaces of a strata.

The coated asphalt sheet still in process may be cut into smaller lanes that are then positioned and combined together. The smaller lanes may be further processed with the option to have portions cutout, the option to have an edged surface cut design, adhesive added to combine portions and a separate adhesive added to either the top or bottom surface in order to adhere whole shingles together on a roof once applied. A release tape or agent may also be applied to either surface. The whole assembly may then be cut into the final shape and design and packaged.

In some embodiments, an overlaid layer of asphaltic material or filled asphaltic material, or polymer modified asphalt, or polymer filled asphalt, or asphalt based laminating material, or asphalt filled laminating material, or glue, or adhesive may comprise:

1) a) A pre-determined uniform thickness;

b) A thickness that may be pre-determined to vary in a shingle manufacturing machine direction during production;

c) A thickness that may be pre-determined to vary in a cross direction during production;

d) A thickness that may be randomly varied in the machine direction during production;

e) A thickness that may be randomly varied in the cross direction during production;

f) A thickness that is applied in a wedge shape configuration during production such that one opposing end is thicker than the other opposing end to form a continuous taper;

g) A thickness that is applied in a wedge shape configuration during production such that one opposing end is thicker than the other opposing end and has a discontinuous, interrupted or staggered taper;

These embodiments may be applied as a secondary application to the bottom, non-exposed side of an asphalt roofing shingle sheet medium in a pre-planned zone(s) as follows:

h) In a pre-determined location;

i) In a continuous length;

j) In a continuous width in the machine direction;

k) In a discontinuous or intermittent fashion in length in the machine direction;

l) In a discontinuous width in the machine direction;

m) In a continuous width in the cross machine direction;

n) In a discontinuous or intermittent fashion in length in the cross machine direction;

o) In a discontinuous width in cross machine direction;

These embodiments may further comprise subsequently surface coating or covering the applied overlaid layer of asphaltic material or the like with a surface material comprising:

p) Fine mineral matter such as is typically used in roofing shingle production such as sand, talc, powdered limestone, mineral granule fines, slate fines, slag fines, vitrified material fines, recycled mineral matter fines, or other non-mineral matter fines such as polymeric, plastic and recycled polymer materials;

q) Or, coarse mineral matter typically used in roofing shingle production such as granular sand, talc, mineral granules, slate granules, slag, granular vitrified materials, granular limestone, or other non-mineral matter material such as polymeric, plastic, foam or other similar based materials;

So as to be present on the surface or embedded wholly or partially within the overlaid layer. Additional embodiments also may comprise features:

2) Where the single layer shingle portion is of a relatively uniform thickness that the overlaid asphaltic material is applied to;

3) Where one or more overlaid layers are subsequently placed over each other, either:

a) In whole coverage over the previously applied overlaid area;

b) Or partial coverage over the previously applied overlaid area;

c) Or, offset to each other with a portion of one or more applications on an existing overlaid layer and a portion off, if wider or narrower or when intermittently applied;

4) Where one or more individual shingle layers in a single wedge shaped or other shingle design have at least one overlaid layer as described in Item 1) above;

5) Where there may be one or more applied overlaid zones on a given layer either top or bottom side of a single wedge shaped design or other shingle design;

6) Where the overlaid layer as described in Item 1) above applied to the bottom surface may be combined with a similarly applied overlaid layer to the top surface of the same asphalt shingle layer;

7) Where the overlaid layer as described in Item 1) above may be combined with a similarly applied overlaid layer to the top surface of an adjacent asphalt shingle layer or to another layer within the same overall shingle design;

8) Where the overlaid layer as described in Item 1) above may be laminated or glued or otherwise adhered to a similarly applied overlaid layer to the top surface of an adjacent asphalt shingle layer or to another layer within the same overall shingle design;

9) Where the overlaid layers between two adjacent combined pieces, such as a top overlay to a bottom overlay, are discontinuous or intermittent and are positioned in relation to each other so that they interlock or nest together;

10) Where the overlaid layers between two adjacent combined pieces, such as a top overlay to a bottom overlay and either the top overlay or the bottom overlay is continuous and the opposing overlaid area is discontinuous or intermittent and are positioned in relation to each other so that a resulting uneven surface combination is created in either the machine or cross machine direction or combination of. An uneven rugged surface effect may approximate and mimic the thickness difference between individual wood shakes;

11) Where one or more individual shingle layers in a single wedge shaped or other shingle design have at least one overlaid layer on either the top or bottom portion as described in Item 1) and the overlaid material in pre-planned zones is offset layer to layer;

12) Where one individual shingle layer in a single wedge shaped or other shingle design has an overlaid layer on the top and bottom portion of the same layer piece as described in Item 1) and the overlaid material in pre-planned zones is offset from top layer portion to bottom layer portion;

13) A lesser thickness may be obtained without an overlaid layer applied to individual shingle layers in a wedge shaped or other shingle design;

14) Where the uppermost portion or layer of the multi-layered design has a cutout portion and the layers beneath are continuous and do not;

15) Where the uppermost portion or layer of the multi-layered design has a cutout portion and one or more layers beneath also have a cutout portion but do not show through at the same location as the uppermost layer;

16) Where the uppermost portion or layer of the multi-layered design has a cutout portion and at least one layer beneath also has a cutout portion that aligns with the same location as the uppermost layer;

17) Where there are final individual cut shingles that have overlaid material on all layers of a multi-layer wedge shape design or other shingle design;

18) Where there are final individual cut shingles that have overlaid material on one or more layers of a multi-layer wedge shape design or other shingle design;

19) Where there are final individual cut shingles that have a mix of overlaid material on one or more layers of a multi-layer wedge shape design or other shingle design mixed in a common packaged bundle;

20) Where the asphalt sheet medium as a whole or partial sheet has a portion or shape of the design cut out from a cutting cylinder or die cut within the sheet before the final cut design occurs;

21) Where the asphalt sheet medium as a whole or partial sheet has a portion or shape of the design cut out from a cutting cylinder or die cut within the sheet before the final cut design occurs and is synchronized to a final shape cutting cylinder occurring afterwards in the process;

22) Where the wedge shape design with overlaid portion or portions are created by different width shingle layers cut from a continuous asphalt sheet medium, arranged and laminated or glued together so as to create a feathered configuration of thickness in going from thicker to thinner. One embodiment is to have the thickest portion as the lowermost exposed edge upon application to a roof; multiple layers laminated together may produce more than one finished shingle;

23) Where the finished wedge shaped shingles or other similar shaped shingle design pieces are packaged so as to be relatively flat by positioning the shingle pieces back to back or front to front with the wider wedge shape portion on opposing sides for adjacent shingle pieces;

24) In some embodiments: 18" width with 8" exposure and a 16" width with 6.5" exposure are included with and without a variable length lowermost exposed cut edge.

The following patents and published applications are incorporated herein by reference in their entirety. U.S. Pat. Nos. 6,920,730, 5,488,807, 7,781,046, 5,347,785, US 20110061326A1, US 20090151288A1, and US 20100266811A1.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes may be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A roofing shingle, comprising:

a shingle body consisting of multiple layers, wherein at least one layer of the multiple layers comprises a rectangular shape, a buttlap portion with a butt edge, a headlap portion, an exposure zone extending from the butt edge toward the headlap portion in a width direction, and the exposure zone is configured to be exposed to the environment when the roofing shingle is installed on a roof;

wherein the buttlap portion is variegated and includes at least one tab;

a first shadowline of granules on at least a portion of the at least one tab of the at least one layer of the multiple layers of the shingle body;

a plurality of second shadowlines of granules in the exposure zone of the at least one layer of the multiple layers of the shingle body, wherein each of the plurality of second shadowlines varies in at least one aspect with respect to the other second shadowlines, and wherein the first and the plurality of second shadowlines also differ from each other in said at least one aspect; and a space between the first and the plurality of second shadowlines on the at least one layer of the multiple layers of the shingle body.

2. The roofing shingle of claim 1, wherein the at least one aspect is color variation, and both the first shadowline and the plurality of second shadowlines extend in a length direction, and at least two of the second shadowlines are spaced apart from each other in the width direction.

3. The roofing shingle of claim 1, wherein the first and the plurality of second shadowlines differ from each other in color by at least about 2 L*CIE color units and not greater than about 50 L*CIE color units, and the variegated buttlap portion does not have cut outs and is not sectioned or interrupted into smaller portions either wholly or partially by cut outs or a cut or slit.

4. The roofing shingle of claim 1, wherein the first and the plurality of second shadowlines comprise a color separation in a color similar to a primary blend or a complementary color of the roofing shingle.

5. The roofing shingle of claim 1, wherein the variegated buttlap portion has a width that is less than a width of the exposure zone, and the variegated buttlap portion does not extend to a fastening zone in the headlap portion, and the first and the plurality of second shadowlines have a same width.

6. The roofing shingle of claim 1, wherein the variegated buttlap portion varies in width by at least about 2% and not greater than about 25%, and at least one of the shadowlines is discontinuous or interrupted in at least one of a width direction and a length direction.

7. The roofing shingle of claim 1, wherein the at least one tab comprises a plurality of tabs with varying widths that are configured to at least partially cover the plurality of second shadowlines of a previous course of roofing shingle by different amounts, and a same shadowline tone or color is repeated with either a darker or lighter color tone as a separation therebetween in a length direction.

8. The roofing shingle of claim 1, wherein at least a portion of at least one shadowline is interrupted at the variegated buttlap portion of an adjacent course of roofing shingle, and the first shadowline is on one tab, but not on another tab.

9. The roofing shingle of claim 1, wherein one or more of the first and the plurality of second shadowlines is continuous and oscillates or varies in width in a length direction.

10. The roofing shingle of claim 1, wherein more than one shadowline varies in color and goes from darker to lighter, or lighter to darker, in a width direction.

11. The roofing shingle of claim 1, wherein the exposure zone comprises a primary shingle color that is of a blend of two or more different colored blend drops or tones; and the plurality of second shadowlines are located at an upper end of the exposure zone adjacent the primary shingle color.

12. A roofing shingle, comprising:

a shingle body consisting of multiple layers, wherein at least one layer of the multiple layers comprises a rectangular shape, a buttlap portion with a butt edge, a headlap portion, an exposure zone extending from the butt edge toward the headlap portion, and the exposure zone is configured to be exposed to the environment when the roofing shingle is installed on a roof;

wherein the buttlap portion is variegated, includes at least one tab, and the buttlap portion does not have cut outs and is not sectioned or interrupted into smaller portions either wholly or partially by cut outs or a cut or slit on the at least one layer of the multiple layers of the shingle body;

a first shadowline of granules on at least a portion of the at least one tab on the at least one layer of the multiple layers of the shingle body;

a second shadowline of granules in the exposure zone on the at least one layer of the multiple layers of the shingle body; and the first and second shadowlines differ from each other in at least one aspect.

13. The roofing shingle of claim 12, wherein the second shadowline comprises a plurality of second shadowlines in the exposure zone, each of which varies in at least one aspect with respect to the other second shadowlines.

14. The roofing shingle of claim 13, further comprising a space comprising a color separation between the second shadowlines in the width direction.

15. The roofing shingle of claim 12, wherein the variegated buttlap portion does not extend to a fastening zone in the headlap portion, and the first and second shadowlines have a same width.

16. The roofing shingle of claim 12, wherein the first shadowline is on one tab, but not on another tab.

17. The roofing shingle of claim 12, wherein at least one of the first and second shadowlines is continuous and oscillates or varies in width in a length direction.

18. A roofing shingle, comprising:

a shingle body comprising multiple layers, wherein at least one layer of the multiple layers comprises a rectangular shape, a buttlap portion with a butt edge, a headlap portion, an exposure zone extending in a width direction from the butt edge toward the headlap portion, and the exposure zone is configured to be exposed to the environment when the roofing shingle is installed on a roof;

wherein the buttlap portion is variegated and includes at least one tab on the at least one layer of the multiple layers of the shingle body, and the buttlap portion does not have cut outs and is not sectioned or interrupted into smaller portions either wholly or partially by cut outs or a cut or slit on the at least one layer of the multiple layers of the shingle body;

a first shadowline on at least a portion of the at least one tab on the at least one layer of the multiple layers of the shingle body;

at least two second shadowlines in the exposure zone on the at least one layer of the multiple layers of the shingle body, the at least two second shadowlines are spaced apart from each other in the width direction, and the at least two second shadow lines vary in color with respect to each other; and the first and the at least two second shadowlines differ from each other in color.

* * * * *